US005080057A

United States Patent [19]

Batzill et al.

[11] Patent Number: 5,080,057

[45] Date of Patent: Jan. 14, 1992

[54] CYLINDER HEAD OF AN INTERNAL-COMBUSTION ENGINE

[75] Inventors: Manfred Batzill, Neuhausen/Fildern; Herbert Ampferer, Sachsenheim, both of Fed. Rep. of Germany

[73] Assignee: Dr. Ing. h.c.F. Porsche AG, Fed. Rep. of Germany

[21] Appl. No.: 625,452

[22] Filed: Dec. 11, 1990

[30] Foreign Application Priority Data

Dec. 11, 1989 [DE] Fed. Rep. of Germany ..... 3940845

[51] Int. Cl.[5] ..... F02F 1/00

[52] U.S. Cl. ..... 123/193 H; 123/90.27

[58] Field of Search ..... 123/193 H, 193 CH, 90.27, 123/90.22

[56] References Cited

U.S. PATENT DOCUMENTS

| | | | |
|---|---|---|---|
| 3,022,775 | 2/1962 | Bouvy | 123/193 H |
| 4,612,885 | 9/1986 | Yoshikawa | 123/90.27 |
| 4,637,356 | 1/1987 | Kuroda | 123/90.27 |
| 4,641,609 | 2/1987 | Tanaka | 123/193 H |
| 4,658,763 | 4/1987 | Gobien et al. | 123/193 H |
| 4,660,529 | 4/1987 | Yoshikawa | 123/90.27 |
| 4,823,747 | 4/1989 | Wagner et al. | 123/193 H |
| 4,944,263 | 7/1990 | Nagano et al. | 123/193 H |
| 5,027,761 | 7/1991 | Fujii et al. | 123/90.27 |

FOREIGN PATENT DOCUMENTS

| | | |
|---|---|---|
| 0262250 | 4/1986 | European Pat. Off. . |
| 1951254 | 2/1971 | Fed. Rep. of Germany . |
| 2342530 | 11/1972 | Fed. Rep. of Germany . |
| 3641129 | 12/1986 | Fed. Rep. of Germany . |
| 3546436 | 1/1987 | Fed. Rep. of Germany . |
| 3641129 | 7/1987 | Fed. Rep. of Germany . |
| 3819655 | 1/1989 | Fed. Rep. of Germany . |
| 2580335 | 10/1982 | France . |

OTHER PUBLICATIONS

One page European Search Report (no date provided).

Automobile Engineer, Mar. 1968, "Ford Formula 2 Racing Engine", pp. 110–113.

Automobile Revue, Zweites Blatt 146/1962 Nr. 27, "Entry Climax-Motoren", 2 pages.

Autombile Engineer, June 1969, pp. 252–253.

MTZ Motortechnische Zeitschrift 45 (1984) 7/8, "Konzeption des Neuen Mercedes-Benz-Motors Mit Vier Ventilen pro Zylinder für den 190 E 2.3-6", by Jörg Abthoff, Hans Brüggemann, Dag-Harald Hüttebräucker und Karl Zeilinger, pp. 275–279.

*Primary Examiner*—Andrew M. Dolinar
*Assistant Examiner*—Marguerite Macy
*Attorney, Agent, or Firm*—Evenson, Wands, Edwards, Lenahan & McKeown

[57] ABSTRACT

A cylinder head of an internal-combustion engine is disclosed which includes a horizontally divided carrier in which camshaft bearings as well as receiving devices for bucket tappets are arranged. The arrangement is constructed rigidly as a result of longitudinal and transverse webs and, by removing the receiving devices from the cylinder housing, permits the use of a simple casting method for the cylinder head housing.

20 Claims, 5 Drawing Sheets

CYLINDER HEAD OF AN INTERNAL-COMBUSTION ENGINE

BACKGROUND AND SUMMARY OF THE INVENTION

The invention relates to a cylinder head of an internal-combustion engine having a divided carrier for receiving camshafts which act upon valves by way of bucket tappets, the carrier having bearings for the camshafts constructed to be detachable from the cylinder head housing and having longitudinal webs extending in the direction of the crankshaft in parallel and at a distance from one another and having transverse webs extending at a right angle with respect to the longitudinal webs.

From the German Patent Document DE-36 41 129 Cl, a camshaft bearing frame is known for an in-line internal-combustion engine having four valves for each cylinder. This camshaft bearing frame is screwed onto the basic housing of the cylinder head as a separate part. This bearing frame comprises a cast part which has webs extending between the cylinders and at the two ends of the cylinder head transversely with respect to the longitudinal direction as well as two webs which extend in parallel in the longitudinal direction and rest on the lateral housing walls of the cylinder head. In the transversely extending webs, lower bearing half-shells are developed for the bearings of camshafts, the upper halves of which bearings are formed by bearing caps which are separated from one another and can be screwed onto the camshaft bearing frame. This bearing frame permits a separate pre-assembly of the camshafts with their bearings. This construction has the disadvantage that, despite the separate camshaft bearing arrangement, an expensively constructed cylinder head housing remains which has undercuts, for example, as a result of the receiving devices for the bucket tappets arranged in it and thus can be cast only with a broken core. The resulting structure and the surface are not optimal with respect to stability.

In the German Patent Document DE 38 19 655, a four-valve cylinder head is disclosed for an internal-combustion engine in which the receiving devices for the bucket tappets are combined in pairs in the manner of spectacles. This cylinder head has a complicated shaping which requires a sand casting procedure because of the many undercuts on the cover side opposite the combustion chamber side. This process requires a thorough and time-consuming cleaning of the cover side after the casting.

It is an object of the invention to provide a cylinder head of high rigidity for a internal-combustion engine which avoids the above-mentioned disadvantages and thus makes it possible to manufacture this cylinder head in a simple casting process. In addition, it must be possible to mount this cylinder head mechanically.

This object is achieved by providing a arrangement wherein the carrier has struts extending as longitudinal webs, the struts being formed of receiving devices for the bucket tappets and bridges connecting these receiving devices. Additional characteristics which develop the invention advantageously are contained in the subclaims.

It is a particular advantage of this invention that the camshaft bearing arrangement as well as the receiving devices serving the guiding of the bucket tappets are removed from the cylinder head housing. As a result, the bottom side facing the combustion chamber and the cylinder head cover side disposed opposite this bottom side, because of their simple shaping, can be manufactured in a common casting process, for example, a chill casting process. The resulting cast structure has high homogeneity and improved material parameters in comparison to the known solutions. As a result, the danger of crack formations in the cylinder head housing is reduced considerably.

Independently of the cylinder head housing, the carrier can be manufactured in the diecasting process and can then be machined in a cost-effective manner. The upper and lower part of the carrier each comprise parts of a center web as well as parts of several transverse webs. For the stiffening of the transverse webs, no separate weight-increasing longitudinal webs are arranged in the carrier; on the contrary, this function is taken over by struts which extend on both sides of the center web in the lower part of the carrier and comprise receiving devices guiding bucket tappets, these receiving devices being connected with one another by way of bridges. Each receiving device, in turn, by way of at least one support, is supported on the part of the center web extending in the lower part of the carrier. In the case of a preferred application in an internal-combustion engine having two inlet and two outlet valves respectively for each cylinder, the receiving devices of a cylinder which are used for the bucket tappet bearing and interact in pairs are connected with one another by way of a bridge constructed as a rib, while the bridge between receiving devices belonging to adjacent cylinders is constructed as lower bearing parts of bearings for two camshafts. Thus a light-weight stiff carrier is obtained, the struts of which, as a result of their design, contribute to the stiffening of the carrier and act as a bearing for bucket tappets.

In another embodiment of the invention the receiving devices of a cylinder which interact in pairs are connected by way of a bridge constructed as a lower bearing part of a bearing of a camshaft, the bridge between receiving devices pertaining to adjacent cylinders being connected by way of a bridge constructed as a rib.

In both embodiments of the invention, the center web widens above each cylinder in a ring-shaped manner to form at least one ring element. The passage openings formed by the ring elements permit the mounting of a spark plug or of an injection device. In another embodiment having two ring elements above each cylinder, for example, a dual ignition can be realized, in this case, two valves being preferably arranged for each cylinder.

In all embodiments of the invention, the contour of the upper part of the carrier is adapted to that of the lower part of the carrier; i.e., it carries a corresponding number of ring elements in the center web, and the upper bearing parts for the bearings of the camshafts are, in each case, arranged above the bridges of the lower part of the carrier constructed as the lower bearing part. For a further stiffening of the carrier, stiffening ribs may be arranged in the upper part of the carrier between the transverse webs. It may therefore be used advantageously in self-igniting as well as in spark-ignited internal-combustion engines with two or more valves for each cylinder as well as in the case of a single or dual arrangement of spark plugs.

Another important advantage is the fact that the invention results in considerable freedoms in the case of the valve position with respect to the combustion chamber as well as in the case of the arrangement of the cylinder head bolts. In the case of a internal-combustion engine having, for example, four valves for each cylinder which are arranged spherically with respect to the combustion chamber, the requirement of a stressable and easily accessible arrangement of the cylinder head screws while bucket tappet guides are arranged in the cylinder head housing and the simultaneous requirement of a minimal constructional length of the internal-combustion engine must not be met. It is only the removal of the camshaft bearing and of the bucket tappets according to the invention which permits a free accessibility to the bores in the cylinder head housing which serve the passage opening of the cylinder head bolts and permits a stressable arrangement of these bores in areas of maximal stability of the cylinder block disposed underneath.

The cylinder head mounting first requires the inserting of the valves into the cylinder head housing and the mounting of the cylinder head bolts. Then the valve springs as well as the valve disks are mounted. Subsequently, either the completely pre-assembled carrier can be screwed onto the cylinder head housing as a complete unit or its individual components can be mounted successively. In the latter case, the lower part of the carrier is inserted first and the bucket tappets are guided into the receiving devices. Subsequently the camshafts are inserted and the upper part of the carrier is screwed onto the lower part of the carrier and the whole carrier is screwed onto the cylinder head housing.

The carrier can be completely mounted mechanically and subsequently can be mechanically mounted on the cylinder head housing.

Other objects, advantages and novel features of the present invention will become apparent from the following detailed description of the invention when considered in conjunction with the accompanying drawings.

DETAILED DESCRIPTION OF THE DRAWINGS

Figure 1:
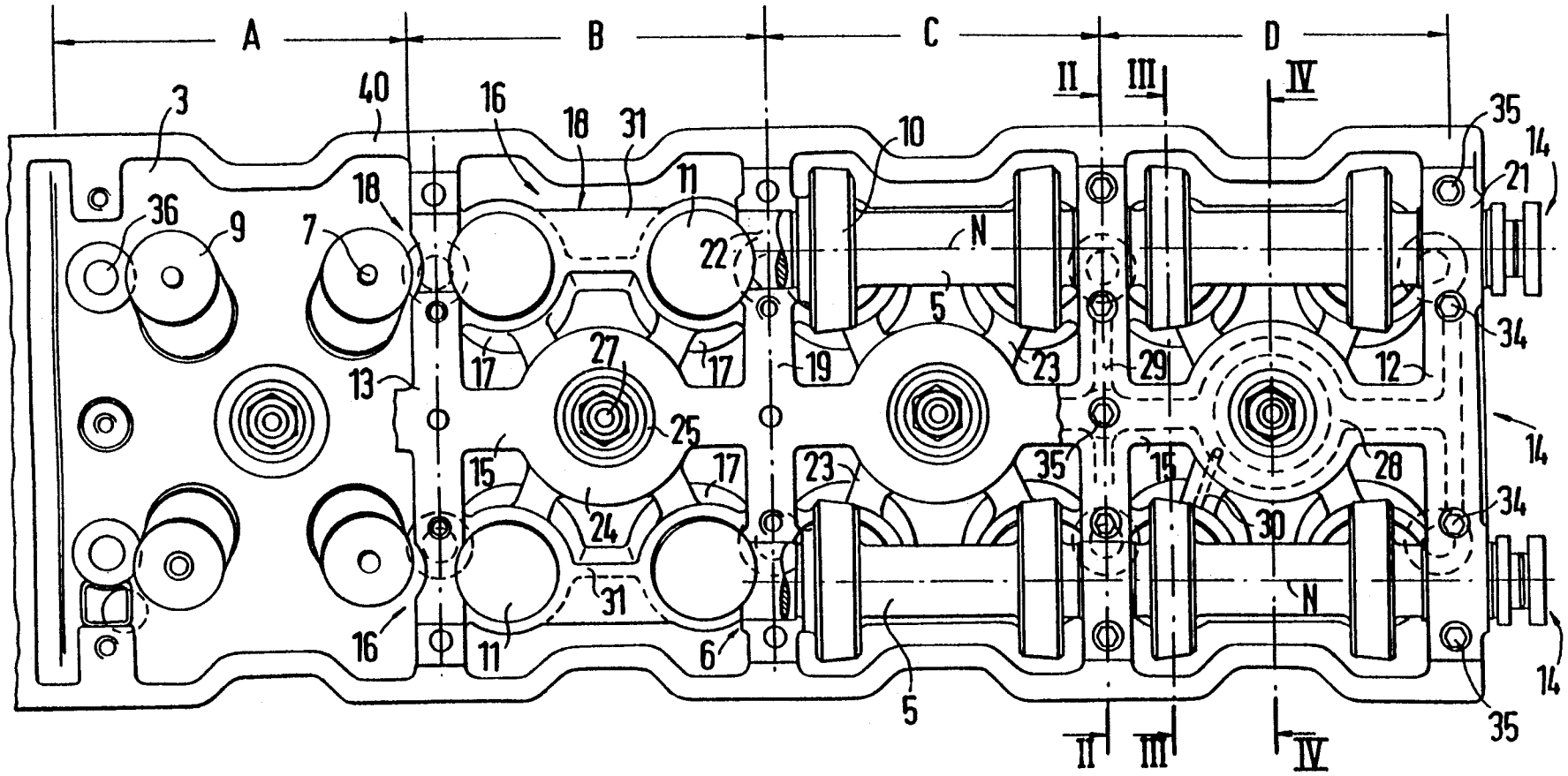
FIG. 1 is a top view of a cylinder head, subdivided into assembly sections which follow one another and constructed according to a preferred embodiment of the invention.
Figure 2:
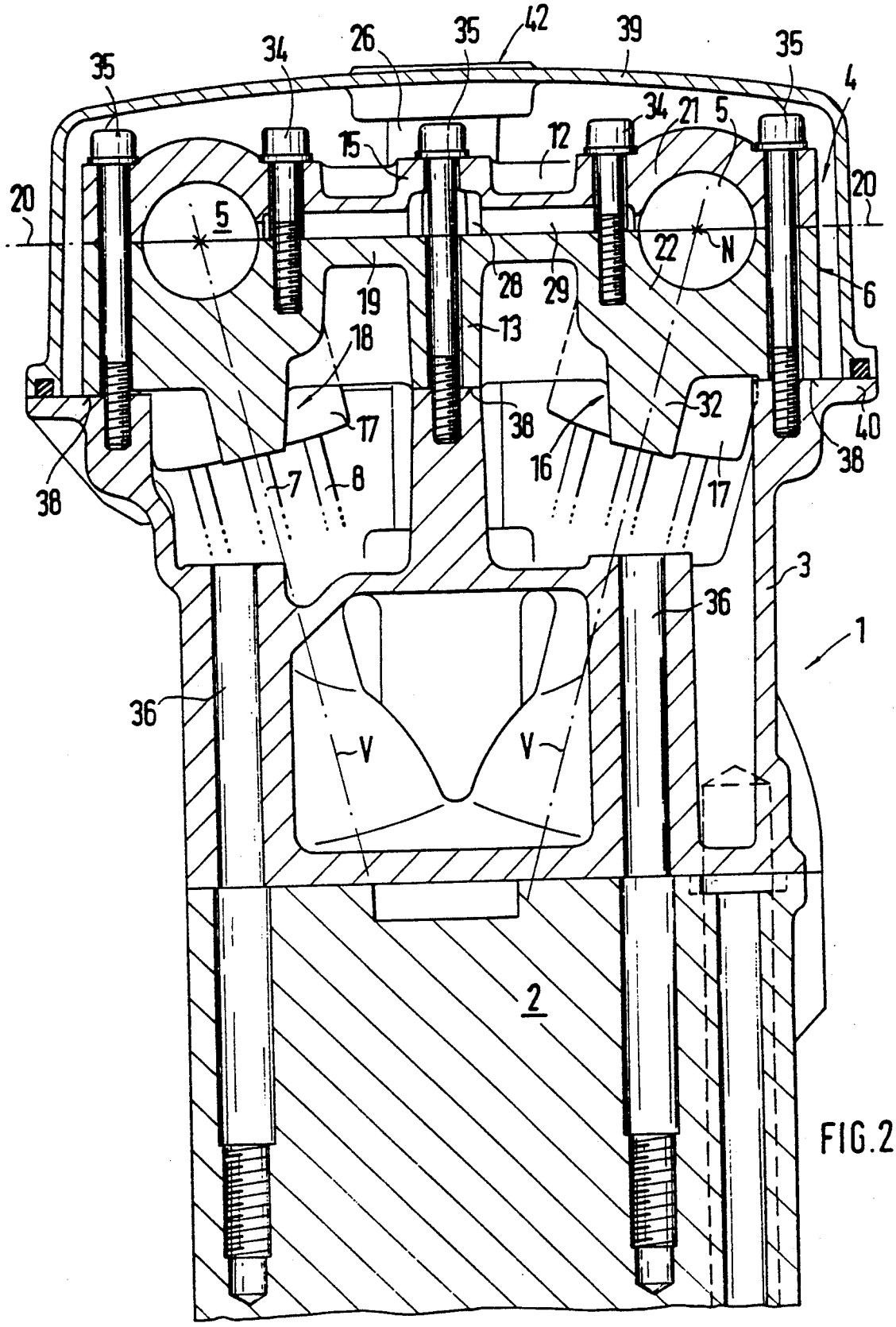
FIG. 2 is a sectional view along Line II—II according to FIG. 1.
Figure 3:
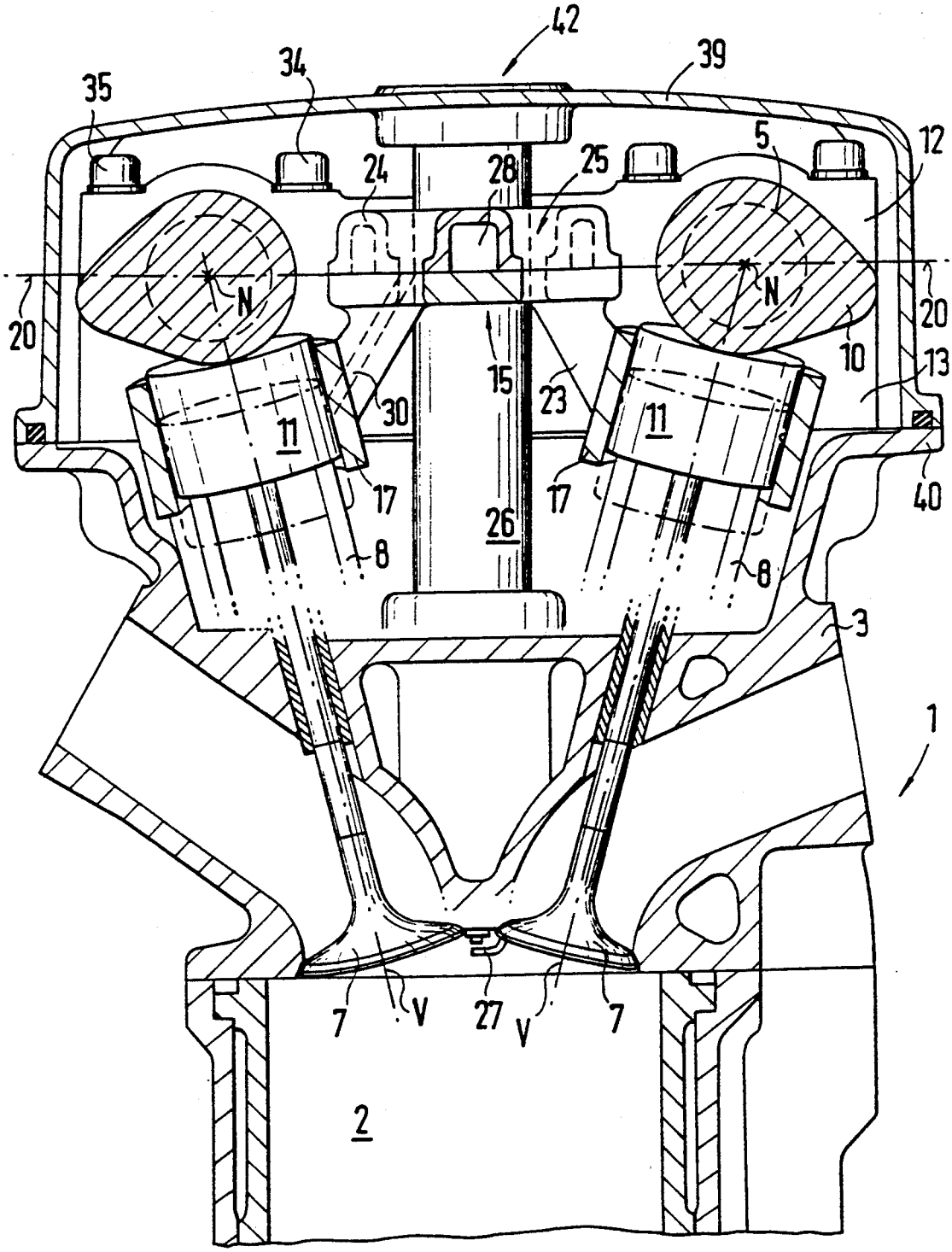
FIG. 3 is a sectional view along Line III—III according to FIG. 1.
Figure 4:
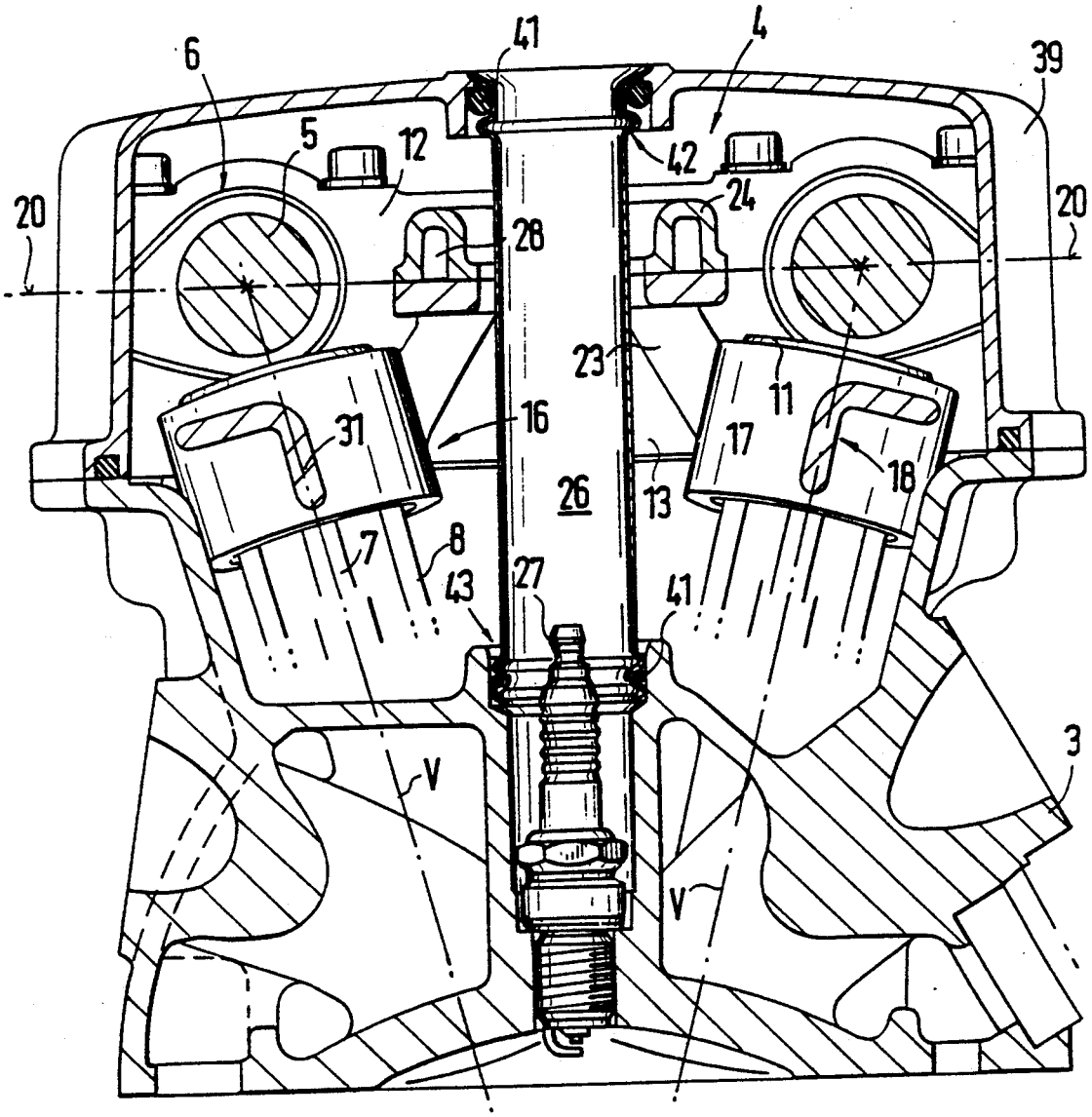
FIG. 4 is a sectional view along Line IV—IV according to FIG. 1.

The cylinder head 1 of a multi-cylinder internal-combustion engine has a cylinder head housing 3 arranged on a cylinder block 2 and a carrier 4 mounted on the housing in which camshafts 5 are arranged in bearings 6. For each cylinder, the cylinder head 1 has four spherically arranged valves 7 with springs 8 and spring disks 9 assigned to them. The valves 7 are actuated by conical cams 10 directly by way of bucket tappets 11. The longitudinal center axes V of the valves 7 along which the valves 7 are moved intersect the longitudinal center axes N of the respective camshaft 5. The carrier 4 comprises an upper carrier part 12 and a lower carrier part 13. In addition, the carrier 4 has a center web 15 extending as a longitudinal web 14 which extends parallel to the crankshaft of the internal-combustion engine and is constructed in the upper part 12 of the carrier as well as in the lower part 13 of the carrier. Struts 16 which are formed of receiving devices 17 for the bucket tappets 11 and bridges 18 connecting these receiving devices 17 extend in the lower part 13 of the carrier on both sides of the center web 15 and at a parallel distance to it. The receiving devices 17 are arranged coaxially with respect to the longitudinal center axes V of the valves 7.

Transverse webs 19 which are developed in the upper part 12 and in the lower part 13 of the carrier extend transversely with respect to the center web 15 and to the struts 16. The longitudinal center axes N of the camshaft 5 extend in the plane junction 20 extending between the upper part 12 and the lower part 13 of the carrier. The bearings 6 are each formed of an upper part 21 of the bearing in the upper part 12 of the carrier and as a lower part 22 of the bearing in the lower part 13 of the carrier.

Each receiving device 17 is connected to the lower part 13 of the carrier by way of at least one support 23. The struts 16, together with the supports 23, extend below the junction 20.

Above each cylinder of the internal-combustion engine, the center web !5 widens in a ring-shaped manner to form a ring element 24 which, in this case, encloses a passage opening 25 and is arranged concentrically with respect to the longitudinal axis Z of the cylinder. It permits the pushing-in of a tube body 26 which permits the access to a spark plug 27.

A lubricant duct system is arranged in the carrier 4 and is connected to the lubricating-oil circulating system of the internal-combustion engine. This system comprises ducts 28, 29, 30. Ducts 28, 29 extend inside the upper part 12 of the carrier in the center web 15 and in the transverse webs 19, and ducts 30 are arranged in the supports 23. At any arbitrary point, which is not shown, duct 28 is connected to the lubricating-oil circulating system of the internal-combustion engine and is used as a distributor for the lubricating oil into ducts 29, 30. Duct 28 surrounds the passage openings 25 with a uniform flow so that ducts 30 connected to the lower part 13 of the carrier in the area of the ring elements 24 supply the receiving devices 17 with lubricating oil for guiding the bucket tappets. Ducts 30 branch off duct 28 in the area of the transverse webs 19 and guide lubricating oil to the bearings 6 of the camshafts 5. The bridges 18 are designed as ribs 31 between the receiving devices 17 pertaining to a cylinder. These ribs 31 will not be required if, in the case of a narrow distance of the pertaining receiving devices 17, these are cast together directly.

Between two receiving devices 17 situated next to one another and belonging to adjacent cylinders, the bridges 18 are constructed as the lower bearing parts 22.

In the area of these lower bearing parts 22, the transverse webs 19 are arranged extending between the struts 16 and are constructed in one piece with the lower bearing parts 22. Below the lower bearing parts 22, the transverse webs 19 have projections 22 which ensure that the receiving devices 17 situated adjacent to a transverse web 9 are rigidly connected with one another along their overall height.

The upper bearing parts 21 are constructed in the part of the transverse webs 19 extending in the upper part 12 of the carrier. On both sides of the upper bearing parts 21 and in the area of the center web 15, bores 33 are arranged in the upper part 12 of the carrier which, together with additional bores 33 in the lower part 13 of the carrier and in the cylinder head housing 3, permit screwed connections 34, 35.

During the assembly of the above-described parts, the cylinder head housing 3 is first fastened to the cylinder block 2 by means of cylinder head bolts 36 after the valves 7 were pushed into corresponding guides. Bores 37 are provided in the cylinder head housing for receiving the cylinder head bolts 36. Subsequently, the springs 8 and the spring disks 9 are mounted on the valves 7. At this point in time, the picture of the overall cylinder head applies that is shown in FIG. 1 in the section marked with an A. Subsequently, as mentioned in the introduction to the specification, the carrier 4 which is completely equipped with the camshafts 5 and the bucket tappets 11, may be mounted as a complete unit or successively as individual component parts. The latter possibility will be described in detail in the following. The bottom part 13 of the carrier is first placed on the cylinder head housing on three contact surfaces 38. Then the bucket tappets 11 are slid into the receiving devices 17. This results in the picture of the overall cylinder head which is shown in the section of FIG. 1 marked by the letter B.

After the camshafts 5 were placed in the lower bearing parts 22 (Section C in FIG. 1), the upper part 12 of the carrier is fixed to the lower part 13 of the carrier by means of the screwed connections 34. The screwed connections 35 penetrate the contact surfaces 38 and brace the lower part 13 of the carrier between the cylinder head housing 3 and the upper part 12 of the carrier, and fasten the carrier 4 in the cylinder head 1 (Section D in FIG. 1). Subsequently, a cover 39 is placed on the cylinder head 1. This cover 39 encloses the carrier 4 in a U-shaped manner and rests on a flange 40 which can be machined together with the contact surfaces 38. Advantageously, the surface situated between the cover 39 and the flange 40 is completely plane and has no bores so that a simple sealing is possible.

The tube body 26 is fitted into the passage opening 25 and seals off the spark plug area by means of two gaskets 41 in an opening 42 of the cover 39 and in a holding device 43 in the cylinder head housing 3. The arrangement of the screwed connections 34, 35 in the plane in which the cylinder head bolts are arranged permits an optimal stressable introduction of force from the carrier 4 into the cylinder block 2.

As mentioned in the introduction to the specification, the invention can also be used advantageously in internal-combustion engines having, for example, two or three valves for each cylinder. In the case of two valves 7, the corresponding receiving devices 17 are situated opposite one another in a plane which extends in parallel to and in the center of two transverse webs 19. In an embodiment with a dual ignition and two valves, two receiving devices 17 are advantageously situated diagonally opposite one another between two transverse webs 19. The center web 15 will then have two ring elements 24 for each cylinder which may also be situated diagonally opposite one another.

Figure 5:
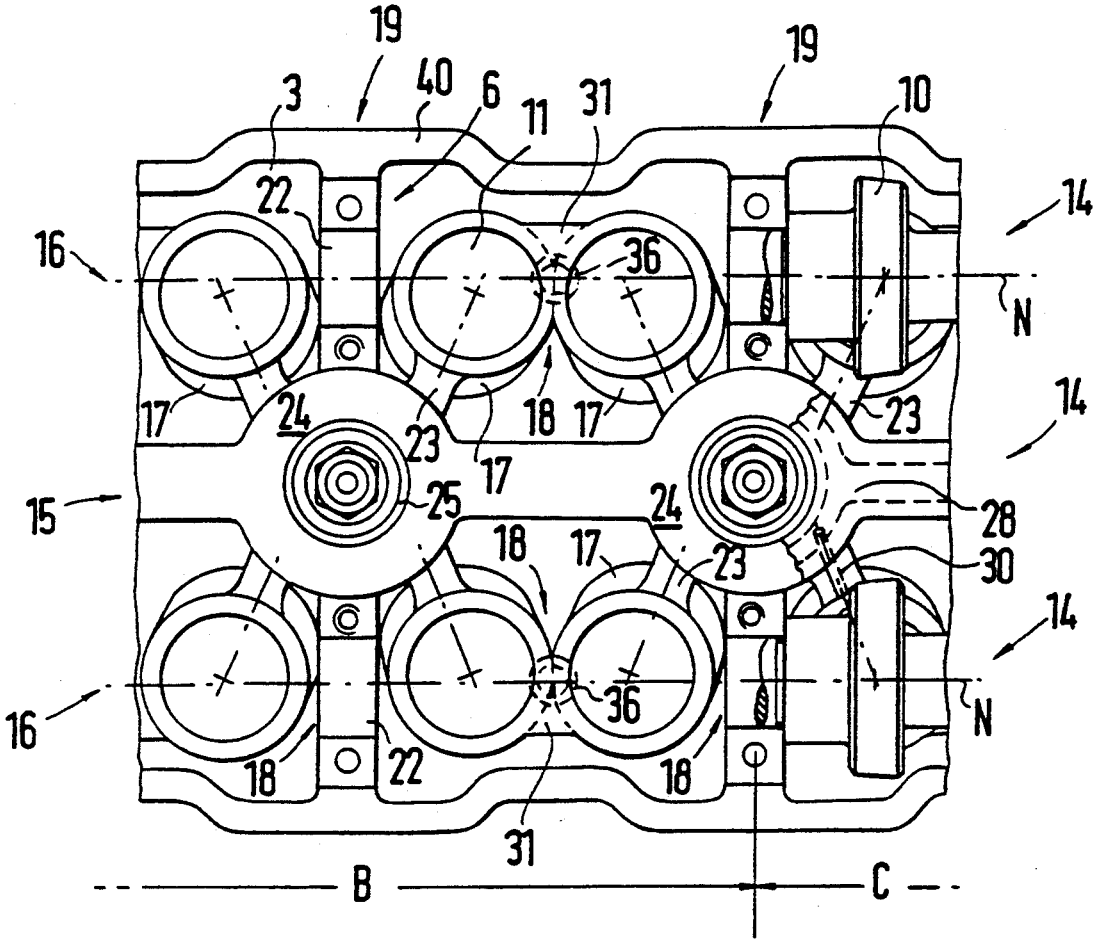
FIG. 5 is a partial top view of another embodiment of the invention.

According to FIG. 5, in another embodiment of the invention, the transverse webs 19 are arranged above each cylinder of the internal-combustion engine and, in this case, accommodate one ring element 24 respectively. Two receiving devices 17 respectively assigned to a cylinder are cast together below a lower bearing part 22 acting as a bridge 18. Two receiving devices 17 situated next to one another and belonging to adjacent cylinders are connected by means of a rib 31.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A cylinder head of a multi-cylinder internal-combustion engine having a divided carrier for receiving camshafts which act upon valves by way of bucket tappets, the carrier having bearings for the camshafts constructed to be detachable from the cylinder head housing and having longitudinal webs extending in the direction of the crankshaft in parallel to one another and at a distance from one another and having transverse webs extending at a right angle with respect to the longitudinal webs, wherein the longitudinal webs include struts forming receiving devices for the bucket tappets and bridges connecting these receiving devices.

2. A cylinder head according to claim 1, wherein the receiving devices are each held by means of two bridges in a strut, the first bridges being constructed as lower bearing parts of the bearings for the camshafts, and the second bridges being constructed as ribs.

3. A cylinder head according to claim 1, wherein the longitudinal webs include a center web arranged in the carrier and extending between two of said struts forming the receiving devices.

4. A cylinder head according to claim 3, wherein the center web and the transverse webs are each constructed in an upper support part and a lower support part forming a support.

5. A cylinder head according to claim 4, wherein the struts are constructed in a bottom part of the carrier.

6. A cylinder head according to claim 3, wherein the center web above each cylinder of the internal-combustion engine widens in a ring-shaped manner to form at least one ring element and, in the process, in each case, encloses one passage opening.

7. A cylinder head according to claim 4, wherein first screwed connections connecting the upper part and the lower part of the carrier and second screwed connections holding the carrier on the cylinder head housing are arranged in the transverse webs.

8. A cylinder head according to claim 7, wherein the receiving devices are arranged coaxially with respect to the longitudinal center axes of the valves.

9. A cylinder head according to claim 2, wherein two adjacent receiving devices respectively connected by way of a rib are arranged above a cylinder of the internal-combustion engine.

10. A cylinder head according to claim 2, wherein two adjacent receiving devices respectively, which are connected by way of a lower bearing part, are arranged above a cylinder of the internal-combustion engine.

11. A cylinder head according to claim 6, wherein the transverse webs extend between adjacent ring elements, and wherein the transverse webs reach around lower bearing parts.

12. A cylinder head according to claim 9, wherein the transverse webs extend between adjacent ring elements, and wherein the transverse webs reach around lower bearing parts.

13. A cylinder head according to claim 6, wherein above each cylinder of the internal-combustion engine, a ring element is arranged coaxially with respect to the cylinder axis and the transverse webs reach around the ring element.

14. A cylinder head according to claim 10, wherein above each cylinder of the internal-combustion engine, a ring element is arranged coaxially with respect to the cylinder axis and the transverse webs reach around the ring element.

15. A cylinder head according to claim 4, wherein each receiving device has a support which is formed of one piece with the lower part of the carrier and is connected to the center web.

16. A cylinder head according to claim 1, wherein a lubricant duct system is arranged in the carrier which comprises ducts and supplies the bearings and the receiving devices.

17. A cylinder head according to claim 16, wherein the lubricant duct system includes a duct which is arranged in a center web above a plane extending between an upper carrier part and a lower carrier part, and wherein ducts are arranged above this plane in transverse webs branching off the duct in the center web.

18. A cylinder head according to claim 16, wherein the lubricant duct system includes ducts extending in center portions of supports for the receiving devices and connected to a duct extending in a ring element.

19. A method of making a cylinder head of a multicylinder internal combustion engine of the type having a divided carrier for receiving camshafts which act upon valves by way of bucket tappets, the carrier having bearings for the camshafts constructed to be detachable from the cylinder head housing and having transverse webs extending at a right angle with respect to longitudinal webs, said method including forming the carrier with struts extending as the longitudinal webs, said method further including forming the struts so as to constitute receiving devices for the bucket tappets and bridges connecting these receiving devices.

20. A method according to claim 9, wherein the receiving devices are each held by means of two bridges in a strut, the first bridges being constructed as lower bearing parts of the bearings for the camshafts, and the second bridges being constructed as ribs.

* * * * *